US006015185A

United States Patent [19]

Buono

[11] Patent Number: 6,015,185

[45] Date of Patent: Jan. 18, 2000

[54] GATE-FOLD CHAIR

[75] Inventor: Steven A. Buono, Greeneville, Tenn.

[73] Assignee: Meco Corporation, Greeneville, Tenn.

[21] Appl. No.: 09/266,523

[22] Filed: Mar. 11, 1999

[51] Int. Cl.[7] ..... A47C 4/00

[52] U.S. Cl. ..... 297/59; 297/16.1; 297/42

[58] Field of Search ..... 297/59, 16.1, 42

[56] References Cited

U.S. PATENT DOCUMENTS

| | | | |
|---|---|---|---|
| 0,250,343 | 12/1881 | Cluff | 297/42 |
| 1,158,212 | 10/1915 | Henderson | 297/59 X |
| 2,860,692 | 11/1958 | Hamilton | 297/42 |
| 3,199,915 | 8/1965 | Hamilton et al. | 297/59 X |
| 3,245,715 | 4/1966 | Gits | 297/59 |

*Primary Examiner*—Peter M. Cuomo
*Assistant Examiner*—Rodney B. White
*Attorney, Agent, or Firm*—Roberts Abokhair & Mardula LLC

[57] ABSTRACT

A folding chair with increased stability having side legs comprising rear portions pivotably connected to lower portions of the rear legs and extending at an acute angle from the rear legs toward the curved portions, and forward portions extending at an acute angle from the curved portions. The seat rotates about a seat rod, and the side legs pivot about the rear legs at a point near the bottom of the rear legs, to provide a chair that in folded position is relatively flat for ease of storage and transportation, and that in unfolded position provides a more stable chair.

9 Claims, 3 Drawing Sheets

GATE-FOLD CHAIR

FIELD OF THE INVENTION

The present invention relates generally to folding chairs and more particularly to a folding chair with increased stability when in use.

BACKGROUND

Folding chairs are collapsible or foldable for ease of storage and transportation. Folding chairs with pivoting legs are often desirable because they generally resemble the configuration and structure of unfoldable chairs and save on storage space. However, folding chairs can lack some of the stability of unfoldable chairs, due at least in part to the foldable nature of the chairs and the generally lightweight construction used for ease of portability.

U.S. Pat. No. 3,199,915 entitled "Folding Chair" and U.S. Pat. No. 2,860,692 entitled "Chair" disclose foldable chairs having legs which in operating position are perpendicular to the seat at each of the four comers of the seat in operating position. Each of the front legs is connected to the seat support which is pivotably connected to the back member of the chair. This pivotable connection at the underside of the seat and back member junction allows for pivoting of the front legs about an axis to permit the legs to be positioned substantially co-planar to the back member. The '915 patent also discloses a mechanism to secure the seat in its operating position.

The general configuration of conventional folding chairs with pivoting legs, particularly in view of its need for light-weight construction, offers little stability to a person who is not appropriately centered on the seat, since the forces pressing down on the seat are not supported equally by the legs at the four corners. Therefore, someone sitting at the front edge of the seat may tip the chair forward. Likewise, someone leaning too heavily against the back of the chair can tilt it in the other direction. This may also be the case in a situation where someone stands on a chair, for example to reach something on a high shelf.

U.S. Pat. No. 250,343 entitled "Folding Chair" discloses a foldable chair having braces at each of the front legs and two rundles extending between each front leg and the back member. This design provides some added stability in comparison to the foldable chair without these supports, however it requires the numerous additional parts of braces and rundles to accomplish the goal, which add to the cost and weight of the chair.

SUMMARY

It is an object of the present invention to provide a folding chair with increased stability when in use.

It is another object of the present invention to provide a lightweight folding chair with increased stability when in use.

It is an also object of the present invention to provide a folding chair with increased stability against tipping forward.

It is another object of the present invention to provide a folding chair with increased stability against tilting backward.

It is a further object of the present invention to provide a folding chair with increased stability and ease of folding.

It is also a further object of the present invention to provide a folding chair with increased stability and a foldable configuration that permits stacking for ease of storage.

The present invention achieves these objects by providing a chair with pivoting side legs having forward and rear portions that extend at an angle from a curved portion of the leg, adapted to support the seat. In the operating position, the angled leg portions serve to distribute uneven forces exerted by a person or object using the chair such that the chair can remain stable while the legs support the seat and the person or object. This invention adds additional stability to the foldable chair by pivotably connecting the side legs to the back member at a lower portion of the rear leg, rather than at a juncture proximate to the exertion of forces on the chair, thereby removing some of the strain at the connection site. In one embodiment, the curved portion is adapted to abut the seat at a forward portion of the seat.

In one embodiment of the present invention in a folded position, the side legs are pivoted inward to be placed between the back member and the seat in folded position. In another embodiment, the side legs may be pivoted outward and about a axis to be placed on opposite side of the back member relative to the seat. In another embodiment, the seat may be pivoted upward.

The frame of the chair is made of any conventional material, including wood, plastic, or preferably metal, and may be of tubular construction. In one embodiment, the seat is pivoted downward to create a flat configuration of the chair in folded position to facilitate efficient and easy storage, such as stacking. The pivoting of the seat is accomplished by use of a rotatable connector such as one or more members shaped to create a space to accommodate a seat rod between the seat and the rotatable connector which is affixed to the underside of the seat. The seat rod, which is affixed to the back member at upper portions of the rear legs, is thereby rotatably secured between rotatable connector and the underside of the seat. Alternatively, other rotating means may be used, including conventional hinges.

In another embodiment, the chair of the present invention is held in a strong and secure operating position by use of fasteners for releaseable engagement of the seat to the side legs. Conventional fasteners and other devices for releaseable engagement may be used to provide a stable and secure chair, and permit facile engagement and disengagement of the seat to the side legs. Embodiments include hook-and-loop devices, magnets, lock mechanisms, and the like.

DETAILED DESCRIPTION OF THE DRAWINGS

The present invention relates to a folding chair that, when unfolded, does not look like a folding chair. In essence, the folding chair of the present invention has a leg configuration that is different from the traditional folding chair where the legs cross at the rear of the seat. The legs of a chair in accordance with the present invention form four substantially straight legs. Another aspect of the present invention is the location of the hinges for the forward legs. The hinges are located on the lower half of the rear legs and preferably toward the bottom of the rear legs. This location assists in weight distribution and gives the chair a sturdier feel. The hinges are preferably of the hidden hinge kind. The term "hidden hinge" includes those hinges that form a smooth surface connection with the rear leg. The hinge lines are visible to close inspection but the hinge is not visible from a distance.

One embodiment of the present invention relates to a "gate folding" chair having a back member with two rear legs. A seat is connected to the back member on a rod extending between the two rear legs. The connection of the seat to the rear legs allow the rotation of the seat around the connecting rod. A pair of side legs are attached to the rear legs at a point about the middle of the rear legs and preferably closer to the lower end of the rear legs. This allows the front legs to be shaped in the form similar to an inverted "U". When the front legs are unfolded under the seat, the point of contact with the seat is closer to the front of the seat. This gives the chair a stronger feel by improving the weight distribution while sitting in the chair. In a regular folding chair, the seat is connected to the legs at a point in the rear half of the seat. The connection at the front half gives more stability and better weight distribution. The forward portion of the front leg is substantially straight with respect to the rear legs and substantially perpendicular to the floor. The front and rear legs are not exactly parallel but do not cross or meet at any point near the seat.

The folding chair of the present invention may be better understood by reference to the figures relating thereto.

Figure 1:
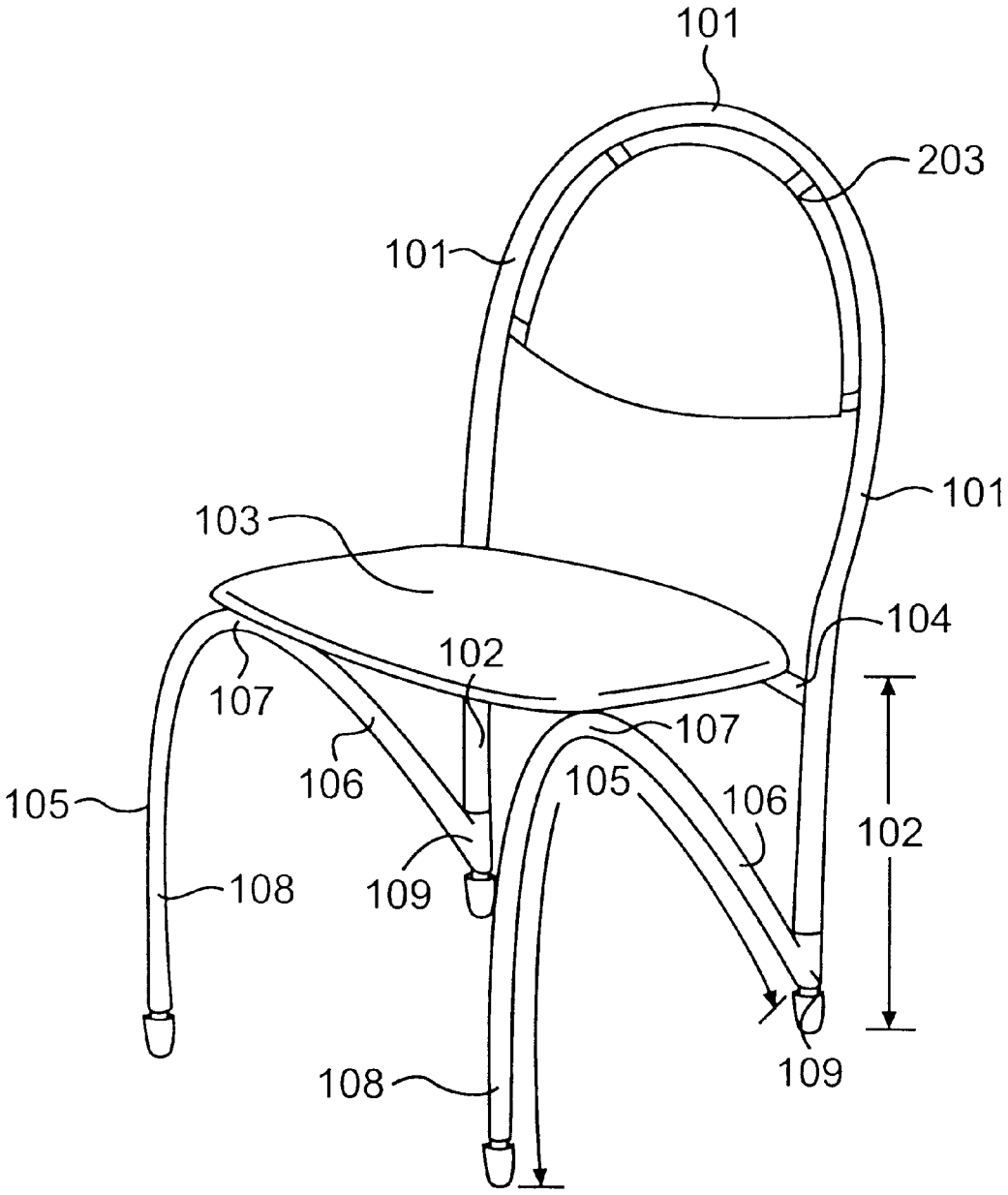
FIG. 1 presents a perspective view of the folding chair of the present invention in operating position.

The chair shown in FIG. 1 comprises a back member 101 having in operating position an upper end that frames back support means 203 and a lower end that serves as rear legs 102 connected to each other by a seat rod 104 extending between and affixed to the two rear legs 102 and rotatably connected by rotatable connector 201 (shown in FIG. 2) to a seat 103 that in operating position abuts and is supported by curved portions 107 of side legs 106 which further comprise rear portions 105 pivotably connected by pivotable connector 109 to the rear legs 102 and extending at an acute angle from the rear legs 102 toward the curved portions 107, and forward portions 108 extending at an acute angle from the curved portions 107.

The side legs 105 pivot about the rear legs 102 of the back member 101 utilizing a pivotable connector 109 pivotably mounted on the lower portion of the rear legs 102 to permit easy folding of the side legs 105 by pivoting the side legs 105 inward toward each other to collapse the chair of the present invention so that the seat 103 can be rotated utilizing a rotatable connector 201 (show in FIG. 2) to cover the side legs 105 in folded position, creating for the chair of the present invention a folded position that is relatively flat for ease of storage and transportation.

Figure 2:
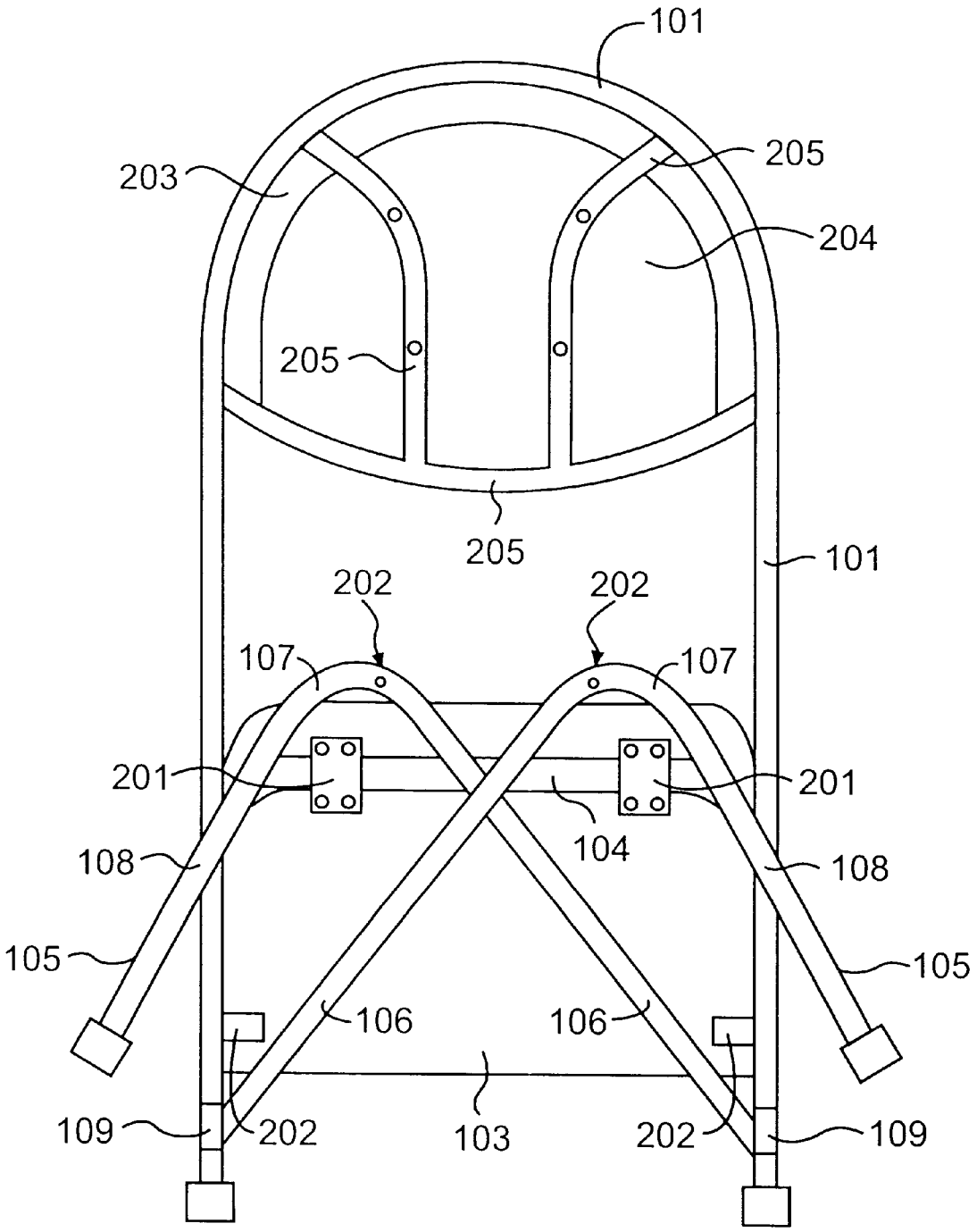
FIG. 2 shows a view of the back of the folding chair of the present invention with the side legs pivoted fully behind, and the seat pivoted downward in one embodiment of the folded position.

As shown in FIG. 2, another embodiment of this invention in folded position places the side legs 105 on the opposite side of the back member 101 from the seat 103 having utilized the pivotable connector 109 to pivot the side legs 105 outward, initially away from each other, to collapse the chair of the present invention so that the seat 103 can be rotated to abut the back member when the chair is in folded position. This embodiment also provides for a relatively flat configuration of the chair in folded position for ease of storage and transportation.

The pivotable connection of the side legs 105 at the lower portion of the rear legs 102 provides for increased stability of the chair, particularly when uneven forces are exerted on the seat 103. The curved portion 107 abuts and supports seat 103. In one embodiment, for additional stability, the curved portion 107 abuts or is fastened to the seat 103 at a forward portion of the seat, as shown in FIG. 1. The configuration of the side legs 105 having forward portions 108 and rear portions 106 extending at acute angles from the curved portion 107 as it abuts and supports the seat 103 allows for forces exerted downward on the seat 103 to experience resistance of forces from several directions and not only an upward direction, thereby increasing stability of the chair in operation.

Figure 4:
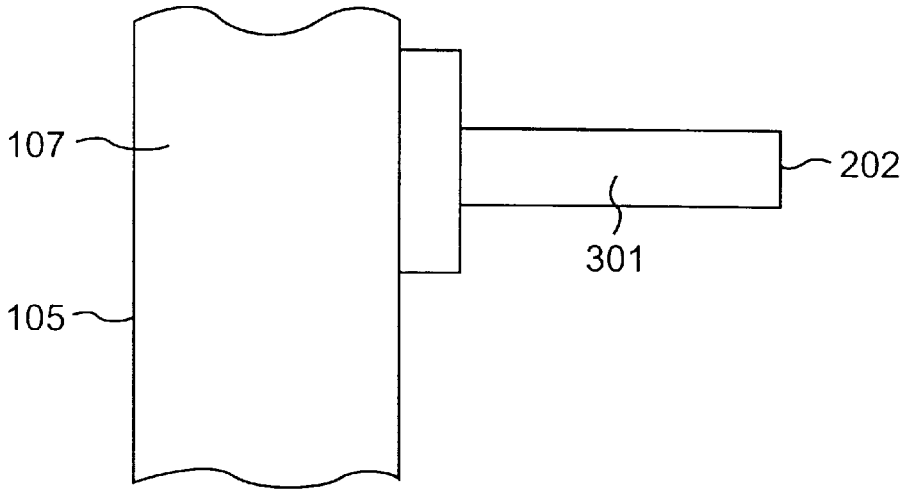

Further increased stability is afforded by use of a fastener 202 to removably engage the seat 103 to the side legs 105. The fastener 202 comprises complementary members affixed to the seat 103 and side legs 105. In a preferred embodiment, the complementary member affixed to the underside of seat 103 is positioned at a distance from the edge of the seat 103 so as to be adapted to removably engage the complementary member affixed to the inner side of the side leg 105, as in FIG. 4.

The rotatable connector 201 rotatably secures the seat 103 to the seat rod 104. Conventional means may be employed for the rotatable connector 201. In one embodiment, the rotatable connector 201 is affixed to the seat 103 by conventional means, such as screws or adhesives, and is shaped such that the seat rod 104 fits snugly between the rotatable connector 201 and the seat 103, as shown in FIG. 2.

The pivotable connector 109 pivotably secures the rear legs 106 of the back member 101 to the side legs 105, and more specifically, to the rear portions 106 of side legs 105. Conventional means may be employed for the pivotable connector 109. In one embodiment, the pivotable connector 109 are affixed to the rear portions 106 of side legs 105 and comprise a tube-like member that surrounds the lower portions of the rear legs 102 to create a rotatable union between the pivotable connector 109 and the rear legs 102.

In one embodiment, the chair comprises components connected by conventional means such as welding, screws. nuts-and-bolts or adhesives. The chair may be fabricated of any material or materials that are sufficiently strong to support the expected use, including wood, plastic, or metal, including metal tubing. The back member 101 may include back support means 203, which may be integral with the back member 101 or comprise components such as a back pad 204 and back pad supports 205.

Figure 3:
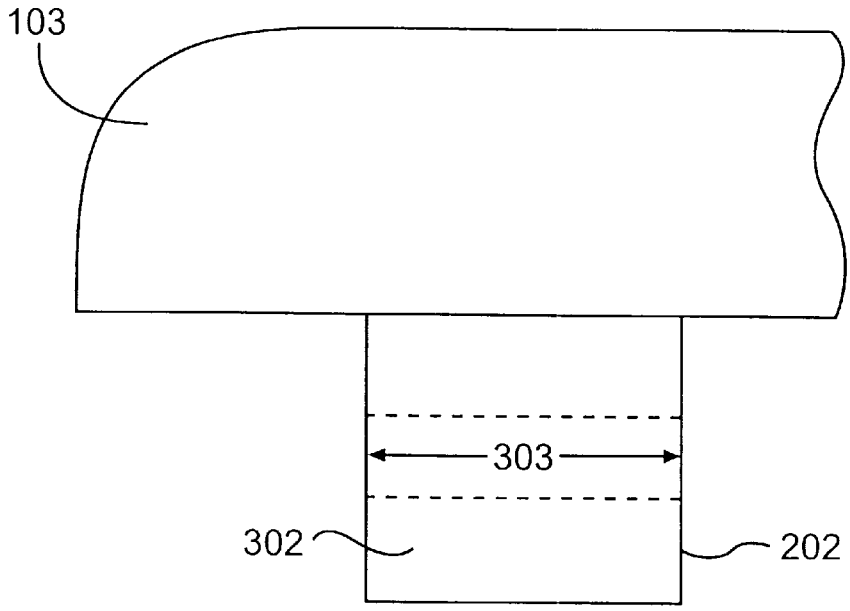
FIGS. 3 and 4 show a cut-away side view of one embodiment of the fastener for relaseable engaging the seat to the side legs, and more specifically, for releaseable engaging the seat to the curved portion of the side legs.

Embodiments include conventional fasteners and attachment devices for fasteners 202. Embodiments of the fasteners 202 include a rod-and bileaf spring connection means, a pressure-snap mechanism, and a hollow spring-bulb projection. FIG. 3 shows a fastener with complementary components affixed to the curved portion 107 and the underside of seat 103 adapted to releaseable engage each other. As the side leg 105 pivots toward the seat 103 in position to abut the curved portion 107, the shaft 301 of fastener 202 comes into contact with receiver 302, and when aligned, is releaseable engaged in channel 303.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, but are not expressly stated above. For example, alternate folding embodiments are possible, such as rotating the seat upward. These and other modifications, alterations and improvements are intended to be suggested by the disclosure herein, and within the scope of the invention. Accordingly, the invention is limited only by the following claims and equivalents thereto.

What is claimed is:

1. A folding chair comprising:

a back member having two rear legs;

a seat having an underside;

a seat rod extending between and affixed to the two rear legs;

a rotatable connector for connecting the seat to the seat rod;

a pair of side legs each comprising a rear portion extending upwardly from a lower portion of the rear leg at an acute angle, a curved portion for abutting the seat and connecting the rear portion to a forward portion of the side leg, the forward portion extending downwardly and forwardly from the curved portion at an acute angle; and a pivotable connector for connecting the side legs to the back member at the lower portion of the rear leg, the pivotable connector adapted to allow the side legs to be placed in a position substantially coplanar to the back member.

2. The folding chair of claim 1 wherein the curved portion of the side legs is adapted to abut the seat underside at a forward portion of the seat.

3. The folding chair of claim 1 wherein the rotatable connector is adapted to allow the seat to be placed in a position substantially coplanar to the back member.

4. The folding chair of claim 1 wherein the pivotable connector is adapted to allow the side legs to be placed in a position substantially coplanar to the back member.

5. The folding chair of claim 1 wherein the curved portion of the side leg and the underside of the seat further comprise a fastener for securing the underside of the seat to the side leg.

6. The folding chair of claim 5 wherein the fastener is a rod-and-bileaf mechanism.

7. The folding chair of claim 5 wherein the fastener is a pressure-snap mechanism.

8. A folding chair comprising:

a back member having two rear legs;

a seat having an underside;

a seat rod extending between and affixed to the two rear legs;

a rotatable connector for connecting the seat to the seat rod and adapted to allow the seat to be placed in a position substantially coplanar to the back member;

a pair of side legs adapted to abut the seat at a forward portion of the seat, each side leg comprising a rear portion extending upwardly from a lower portion of the rear leg at an acute angle, a curved portion for abutting the seat at a forward position and connecting the rear portion to a forward portion of the side leg, the forward portion extending downwardly and forwardly from the curved portion at an acute angle; and a pivotable connector for connecting the side legs to the back member at the lower portion of each rear leg.

9. The folding chair of claim 8 wherein the curved portion of the side leg and the underside of the seat further comprise a fastener for securing the seat to the side leg.

* * * * *